US010082363B2

(12) United States Patent
Burgess

(10) Patent No.: US 10,082,363 B2
(45) Date of Patent: Sep. 25, 2018

(54) AUTOMATIC/SEMI-AUTOMATIC RIFLE GRIP AND METHOD OF USING THE SAME

(71) Applicant: Joshua K. Burgess, Spring, TX (US)

(72) Inventor: Joshua K. Burgess, Spring, TX (US)

( * ) Notice: Subject to any disclaimer, the term of this patent is extended or adjusted under 35 U.S.C. 154(b) by 0 days.

(21) Appl. No.: 15/374,581

(22) Filed: Dec. 9, 2016

(65) Prior Publication Data

US 2018/0164071 A1 Jun. 14, 2018

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41C 23/18; F41C 23/00; F41C 27/00; F41C 7/04; F41A 35/00
USPC ..... 42/85, 71.01, 72, 74, 104, 84
See application file for complete search history.

(56) References Cited

U.S. PATENT DOCUMENTS 1,123,180 A * 12/1914 Day ..... F41C 23/08 42/74
2,104,129 A * 1/1938 Kress ..... F41C 23/16 42/71.01
3,023,527 A * 3/1962 Leek ..... F41C 23/00 42/71.01
3,683,538 A * 8/1972 Locatelli ..... F41C 23/08 42/74
3,739,167 A * 6/1973 Avery ..... F21L 14/00 124/88
4,405,223 A * 9/1983 Shull ..... F41C 23/10 396/420
6,622,416 B2 * 9/2003 Kim ..... F41G 1/35 362/110
6,671,991 B1 * 1/2004 Danielson ..... F41C 23/00 42/114
7,441,918 B2 * 10/2008 Kim ..... F41G 1/34 200/18
7,827,726 B2 * 11/2010 Stokes ..... F41C 23/16 362/111
7,845,105 B1 * 12/2010 Cahill ..... F41C 23/16 200/86 R
8,117,782 B2 * 2/2012 Gross ..... F41C 23/16 362/110
8,438,769 B1 * 5/2013 Ghannam ..... F41G 11/003 16/430
8,683,733 B2 * 4/2014 Gross ..... F41C 23/16 362/110
8,875,434 B2 * 11/2014 Michal ..... F41C 23/16 42/90
9,062,933 B1 * 6/2015 Allen ..... F41G 1/35
9,395,151 B2 * 7/2016 Somogy ..... F41C 23/16
2002/0184810 A1 * 12/2002 Day ..... F41C 27/00 42/79
2004/0107621 A1 * 6/2004 Segalle ..... F41C 23/10 42/71.02

(Continued)

*Primary Examiner* — Derrick R Morgan
(74) *Attorney, Agent, or Firm* — R. Tracy Crump

(57) ABSTRACT

A grip for a rifle is configured and adapted to be mounted to the handguard of the rifle and is only one of left or right handed. The grip is adapted and configured such that, when operating the rifle and holding the grip, a person's palm will extend adjacent one of the opposite sides of the rifle with the grip therebetween and the person's fingers will extend across and below the bottom of the rifle with the grip therebetween.

12 Claims, 11 Drawing Sheets

(56) References Cited

U.S. PATENT DOCUMENTS

| | | | | |
|---|---|---|---|---|
| 2005/0195385 | A1* | 9/2005 | Holmberg | F41C 27/00 356/8 |
| 2007/0006511 | A1* | 1/2007 | Casas Salva | F41C 23/16 42/85 |
| 2007/0074442 | A1* | 4/2007 | Richeson | F41C 23/22 42/132 |
| 2007/0271832 | A1* | 11/2007 | Griffin | F41C 23/16 42/72 |
| 2010/0229448 | A1* | 9/2010 | Houde-Walter | F41C 23/16 42/72 |
| 2012/0005930 | A1* | 1/2012 | Cragg | F41A 11/02 42/1.06 |
| 2012/0085013 | A1* | 4/2012 | Cahill | F41A 35/02 42/96 |
| 2012/0266514 | A1* | 10/2012 | Michal | F41C 23/16 42/90 |
| 2014/0196342 | A1* | 7/2014 | Syrengelas | F41C 7/02 42/71.01 |
| 2015/0096215 | A1* | 4/2015 | Somogy | F41C 23/16 42/71.01 |
| 2015/0345896 | A1* | 12/2015 | Michal | F41C 23/16 42/75.01 |
| 2016/0061560 | A1* | 3/2016 | Saadon | F41G 11/003 42/72 |
| 2016/0091272 | A1* | 3/2016 | Hines | F41C 23/16 42/90 |
| 2016/0169610 | A1* | 6/2016 | Hines | F41C 27/00 42/90 |
| 2016/0327371 | A1* | 11/2016 | Teetzel | F41G 11/003 |
| 2017/0191792 | A1* | 7/2017 | Holmes | F41C 23/16 |
| 2017/0234646 | A1* | 8/2017 | Flagler | F41C 23/16 42/71.01 |

* cited by examiner

AUTOMATIC/SEMI-AUTOMATIC RIFLE GRIP AND METHOD OF USING THE SAME

CROSS-REFERENCE TO RELATED APPLICATIONS

Not Applicable.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention relates generally to automatic and semi-automatic rifles. More specifically, the present invention pertains to a handed grip configured in a manner for a person to hold a rifle via a particular one of his or her hands while firing the rifle via his or her other hand.

General Background

When firing a rifle, a person typically grasps the receiver and/or stock with his or her trigger-finger hand while he or she simultaneously supports the fore-end of the rifle with his or her other hand via the forestock or handguard of the rifle. Most people feel comfortable shooting only when using a particular one of his or her hands (left or right) as his or her trigger-finger hand. In other words, in general, a shooter is either a left-handed shooter or a right-handed shooter. Thus, it follows then that most people also always grasp the forestock or handguard of the rifle with a particular one of their hands (i.e., their non-trigger finger hand).

When fired at a high rate or repetitively in quick succession, semi-automatic and fully automatic rifles tend to generate significant heat that causes the barrel to reach temperatures above that which can be tolerated by a person's hand. A design goal of the forestock or handguard of such rifles is to isolate a person's hand from such heat while still allowing the person to support the fore-end of the rifle by hand. With an assault rifle, such as an M4 or AR-15, the rifle often comprises a handguard that encircles the barrel and that is also radially spaced from the barrel such that heat cannot be conducted directly from the barrel to the handguard. Thus, such a handguard may serve as a grip. In addition, such a handguard also typically comprises one or more rails for attaching accessories (e.g., for mounting sites, lasers, flashlights, etc.) to a rifle. Nonetheless, even a handguard that is radially spaced from the barrel may itself become too hot to hold directly following the firing of numerous rounds in quick succession. Similarly, shooting suppressed (i.e., with a silencer) generates more heat than shooting unsuppressed and can heat the handguard beyond which it can be comfortably held. Thus, a rifle with such a handguard may also comprise a grip attached to the handguard that further isolates the shooter's hand from the heat of the barrel.

SUMMARY OF THE INVENTION

The invention disclosed herein is directed to a rifle grip adapted to be attached to a handguard. The grip is a "handed" grip, in that it is configured to be grasped by only one of a person's left or right hands. The grip is contoured for that hand and provides a shooter with a firm and comfortable grip on the rifle that is consistent and repeatable. The grip may also comprise an electronic pressure switch configured to allow a shooter to activate another accessory attached to the rifle via the thumb of the shooter's hand gripping the grip.

In one aspect of the invention, a rifle has a top, a bottom, and opposite sides, a gun barrel, a handguard encircling and radially spaced from the barrel, and a grip. The handguard has opposite sides, a top, and a bottom. The grip is exteriorly fixed to the rail and is configured and adapted to be only one of left or right handed. The grip is further adapted and configured such that, when operating the rifle, a person's palm can extend adjacent one of the opposite sides of the handguard with the grip therebetween and the person's fingers can extend across and below the bottom of the handguard with the grip therebetween.

In another aspect of the invention, a grip for a rifle having a top, a bottom, and opposite sides, a gun barrel, and a handguard encircling and radially spaced from the barrel, is configured and adapted to be mounted to the handguard of the rifle and is only one of left or right handed. The grip is further adapted and configured such that, when operating the rifle and holding the grip, a person's palm will extend adjacent one of the opposite sides of the rifle with the grip therebetween and the person's fingers will extend across and below the bottom of the rifle with the grip therebetween.

In yet another aspect of the invention, a method of operating a rifle comprises holding a rifle. The rifle has a top, a bottom, opposite sides, a gun barrel, a handguard encircling and radially spaced from the barrel, and a grip. The rail has opposite sides, a top, and a bottom. The grip is exteriorly fixed to the handguard and is configured and adapted to be only one of left or right handed. The method also comprises gripping the grip with said one of the left or right hands in a manner such that the palm of said hand extends adjacent one of the opposite sides of rifle with the grip therebetween and the fingers of said hand extend across and below the bottom of the rifle with the grip therebetween. The method further comprises firing the rifle while gripping the grip as described above.

Further features and advantages of the present invention, as well as the operation of the invention, are described in detail below with reference to the accompanying drawings.

Figure 1:
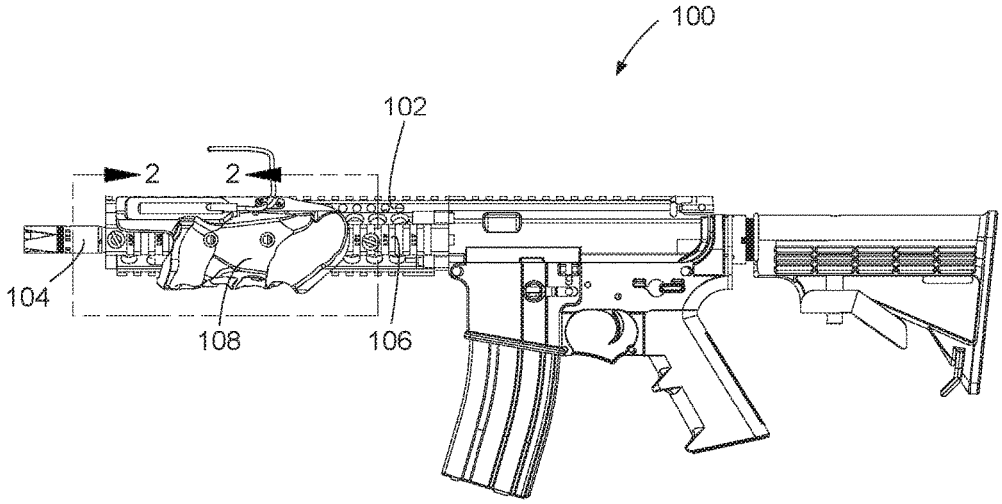
FIG. 1 depicts a side view of a rifle having a grip in accordance with the invention.
Figure 2:
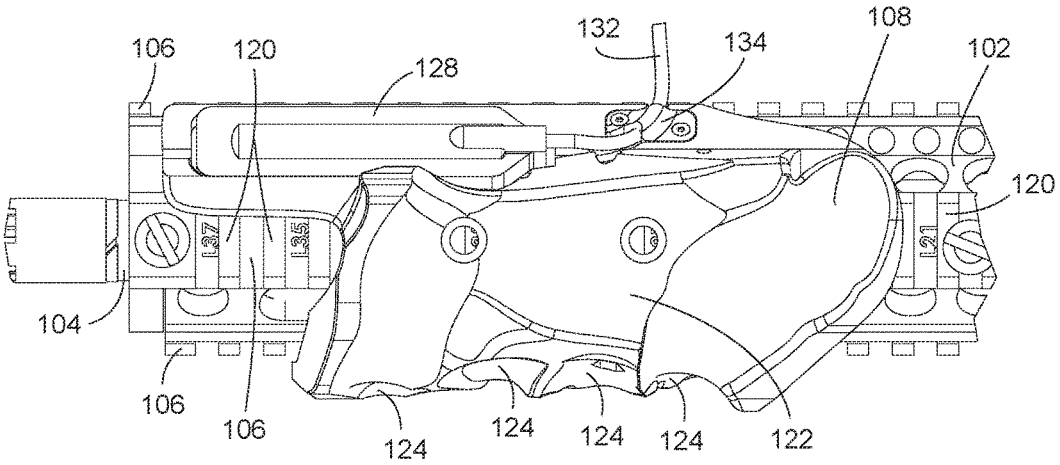
FIG. 2 is a detail view of FIG. 1 within the region bound by the line 2-2 and focuses on the grip.
Figure 3:
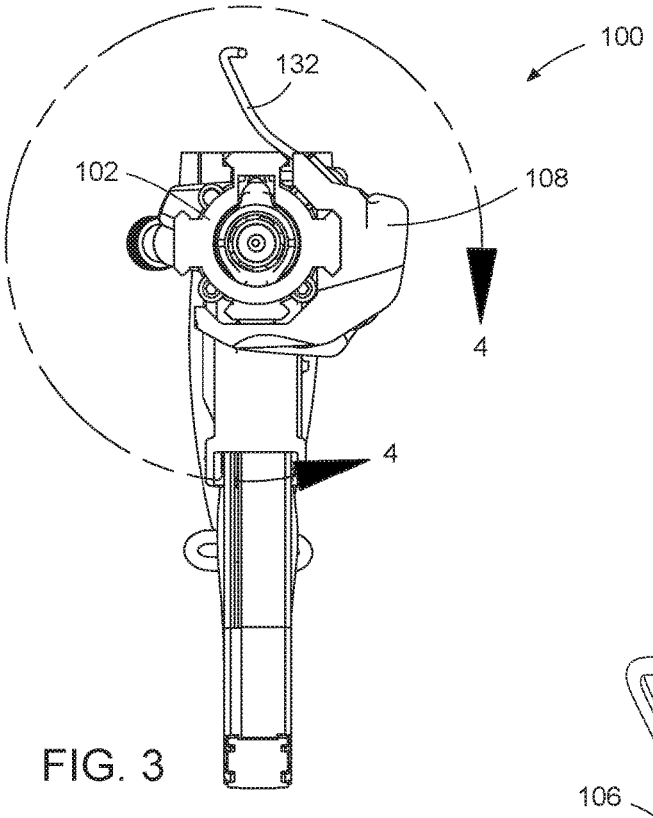
FIG. 3 is a front view of the rifle shown in FIG. 1.
Figure 4:
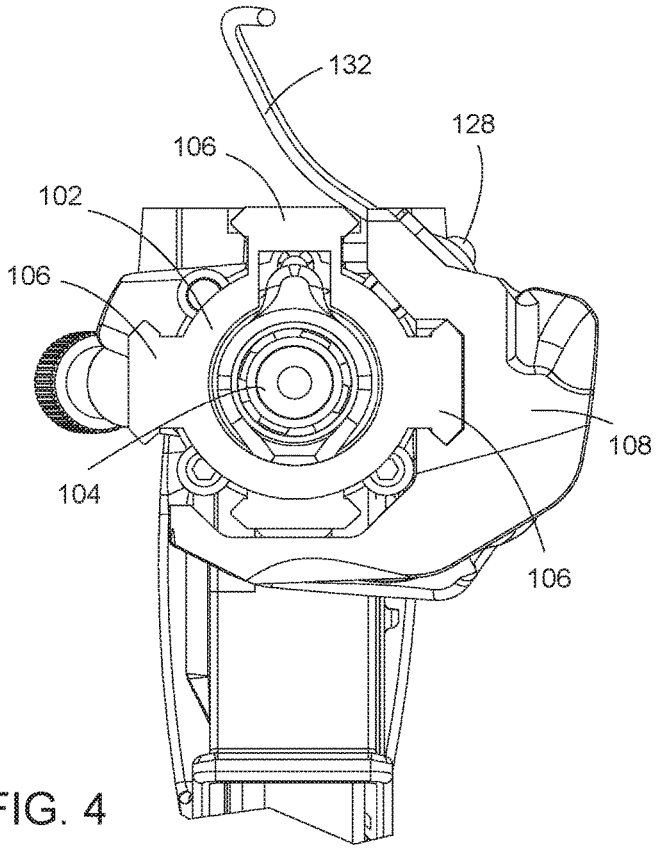
FIG. 4 is a detail view of FIG. 3 within the region bound by the line 4-4 and focuses on the barrel, handguard and grip.
Figure 5:
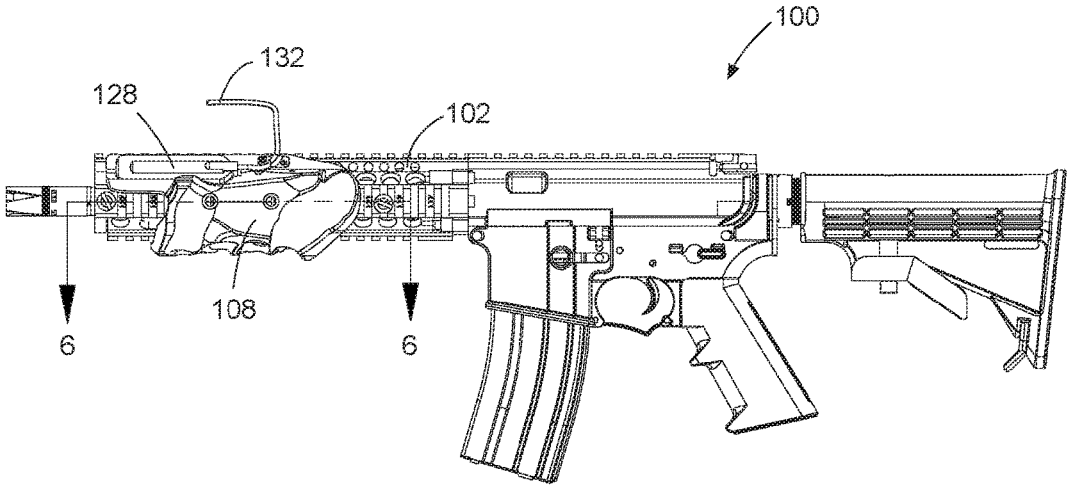
FIG. 5 is a side view of the rifle shown in FIG. 1 showing where the cross-section of FIG. 6 is taken.
Figure 6:
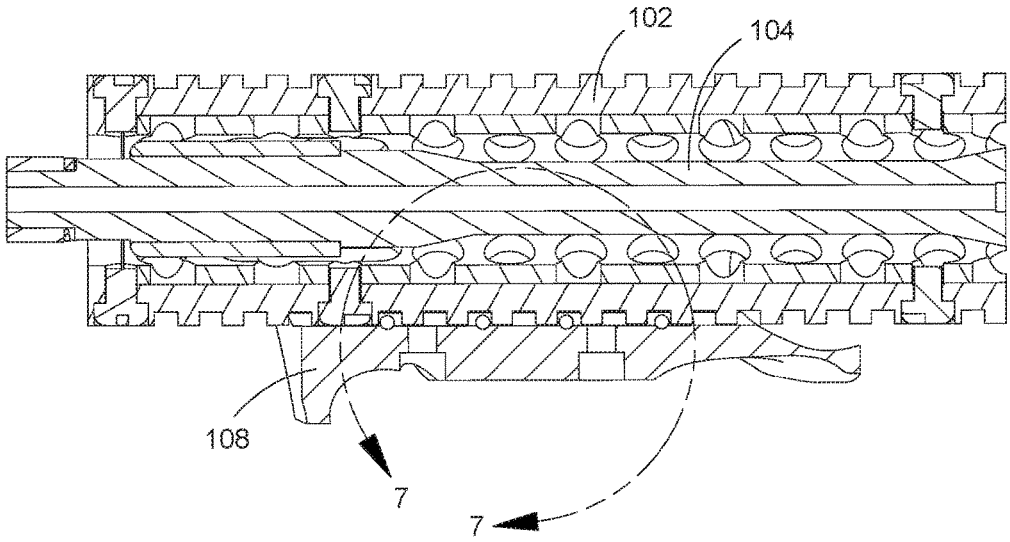
FIG. 6 is a detail cross-sectional view taken about the line 6-6 shown in FIG. 5.
Figure 7:
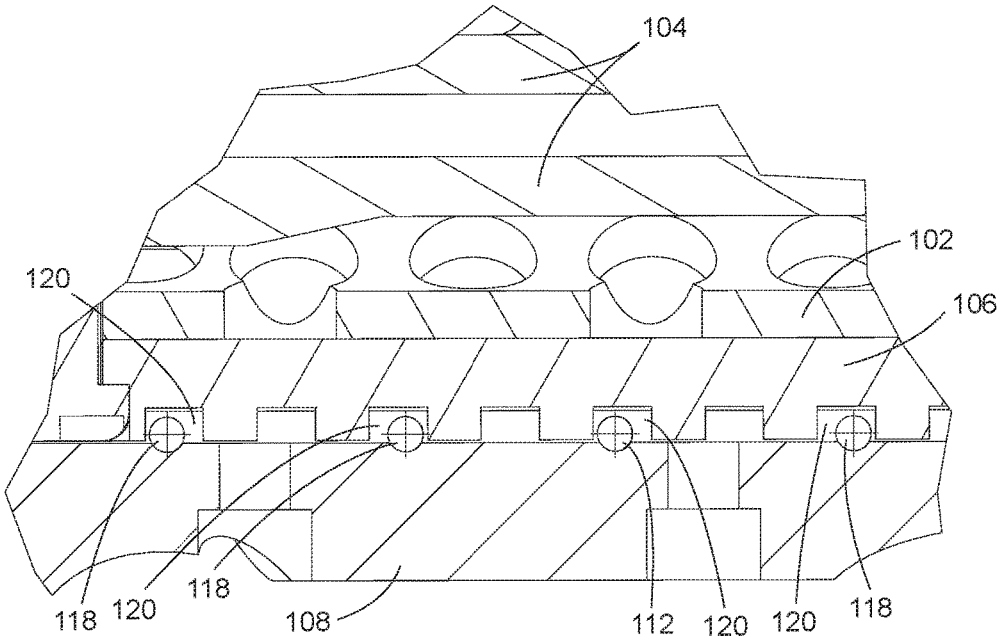
FIG. 7 is a detail view of FIG. 6 within the region bound by the line 7-7 and focuses on the screws that secure the grip to the handguard.
Figure 8:
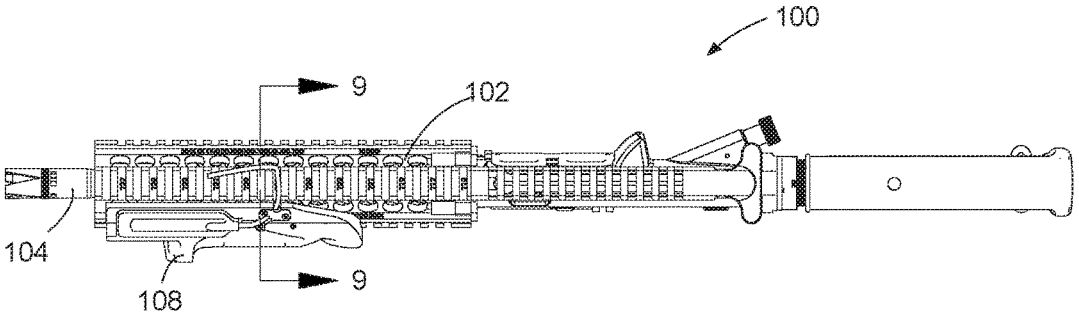
FIG. 8 is a top view of the rifle shown in FIG. 1.
Figure 9:
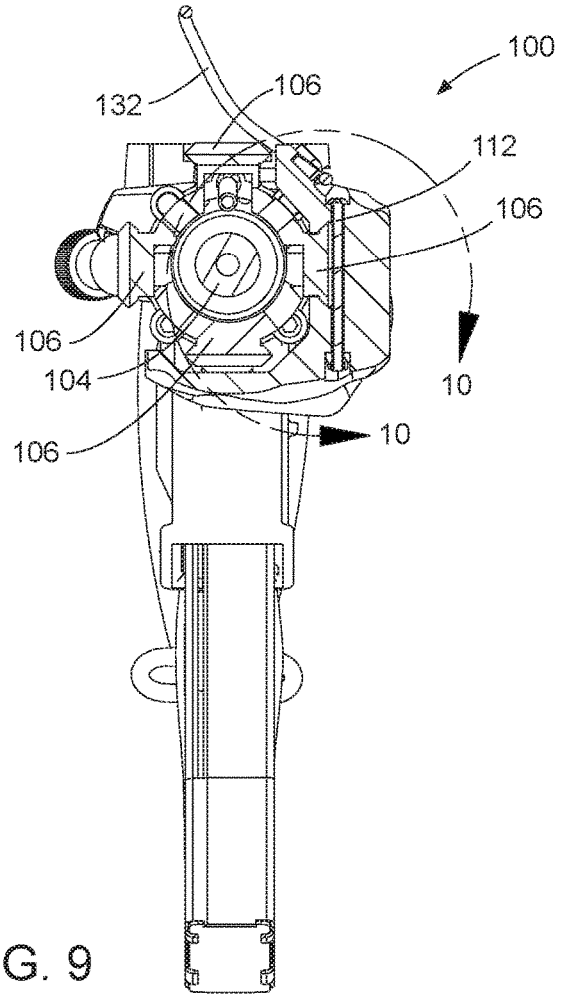
FIG. 9 is a cross-sectional view of the rifle taken about the line 9-9 shown in FIG. 8.
Figure 10:
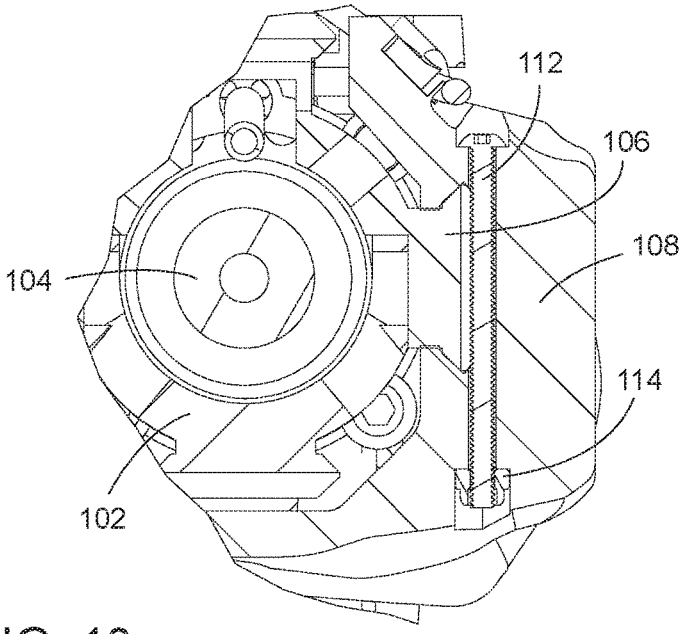
FIG. 10 is a detail view of FIG. 9 within the region bound by the line 9-9.
Figure 11:
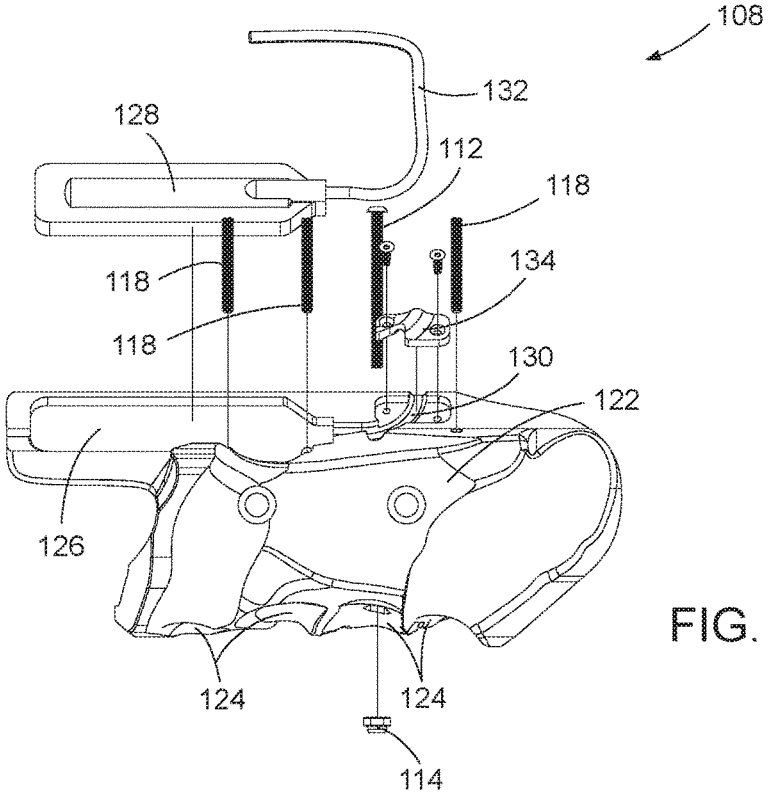
FIG. 11 is an exploded side view of the grip of the rifle shown in FIG. 1.
Figure 12:
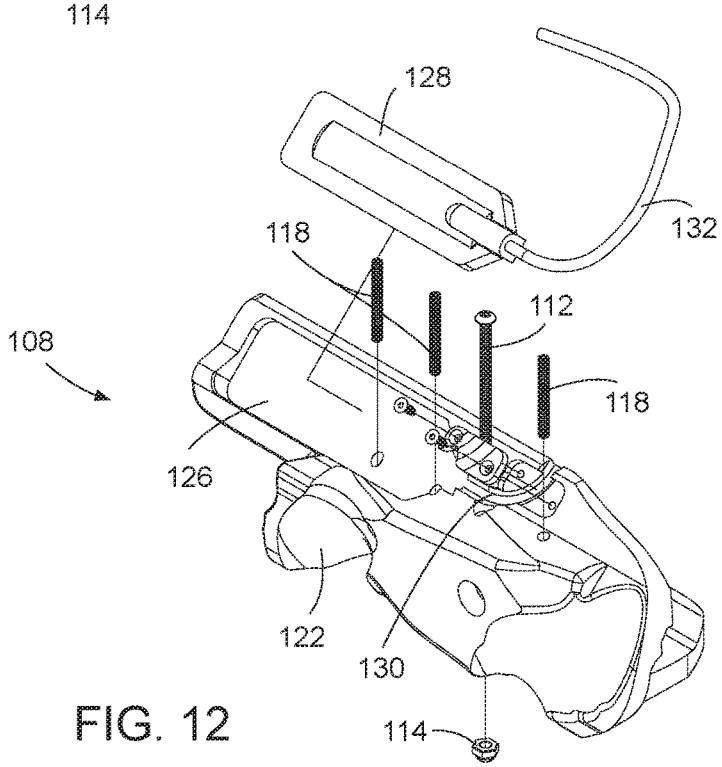
FIG. 12 is an exploded perspective view of the grip of the rifle shown in FIG. 1.

Reference numerals in the written specification and in the drawing figures indicate corresponding items.

DETAILED DESCRIPTION

Figure 13:
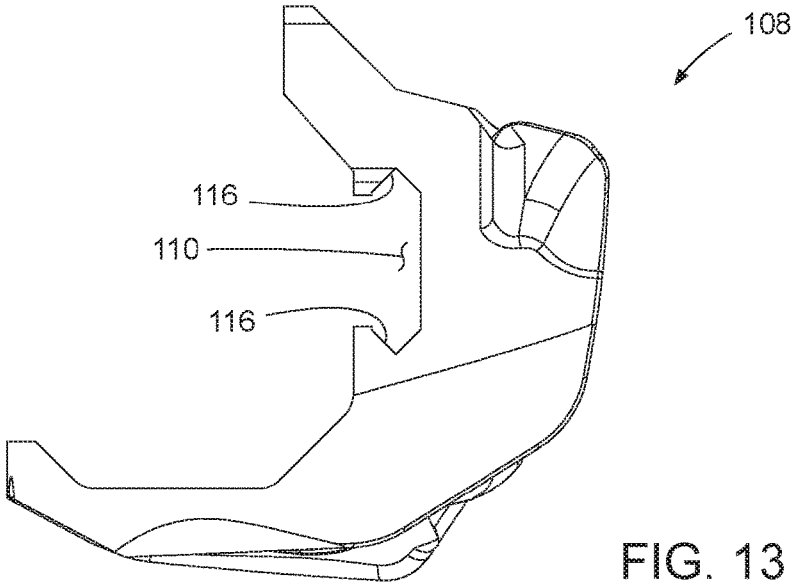
FIG. 13 is a front view of the grip of the rifle shown in FIG. 1.
Figure 14:
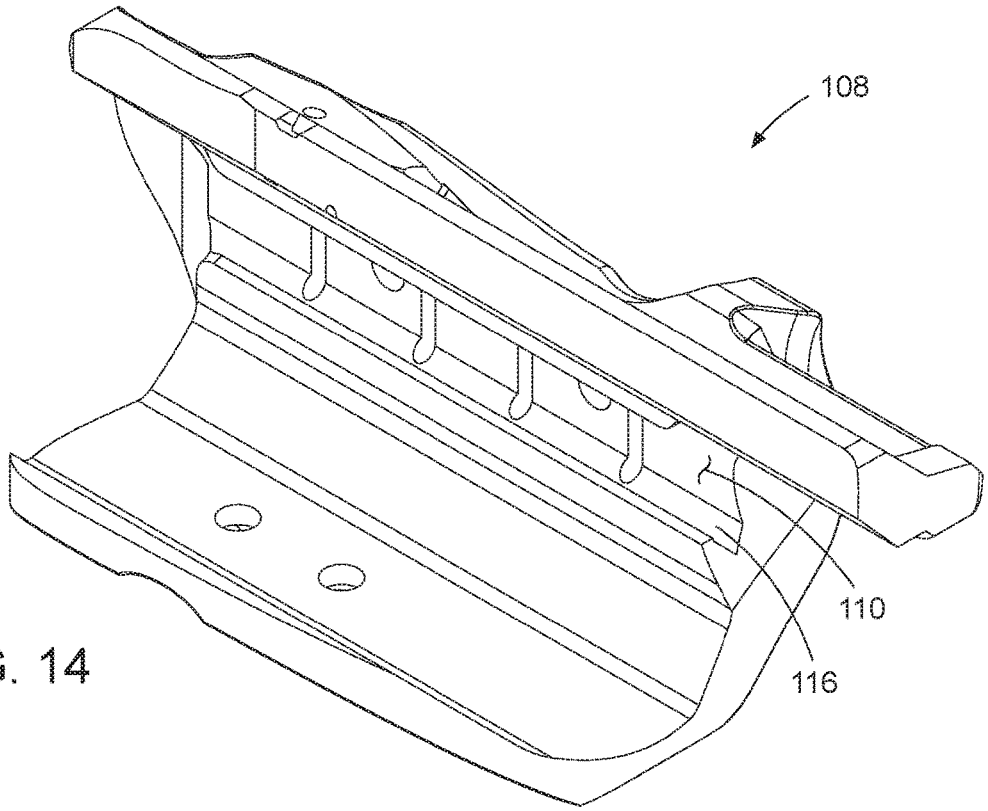
FIG. 14 is a perspective view of the grip of the rifle shown in FIG. 1 showing the interior side of the grip.
Figure 15:
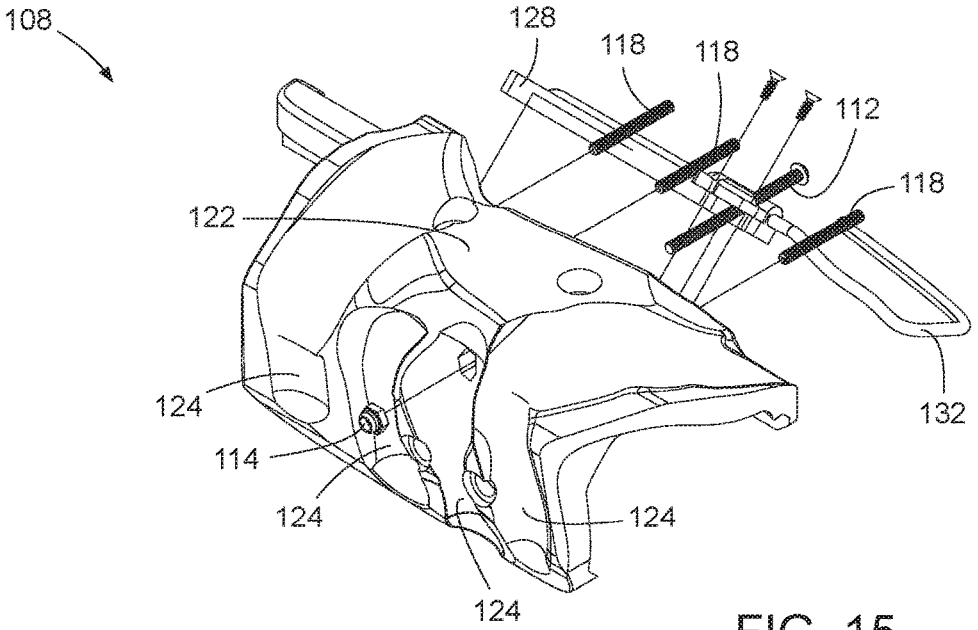
FIG. 15 is another exploded perspective view of the grip of the rifle shown in FIG. 1.
Figure 16:
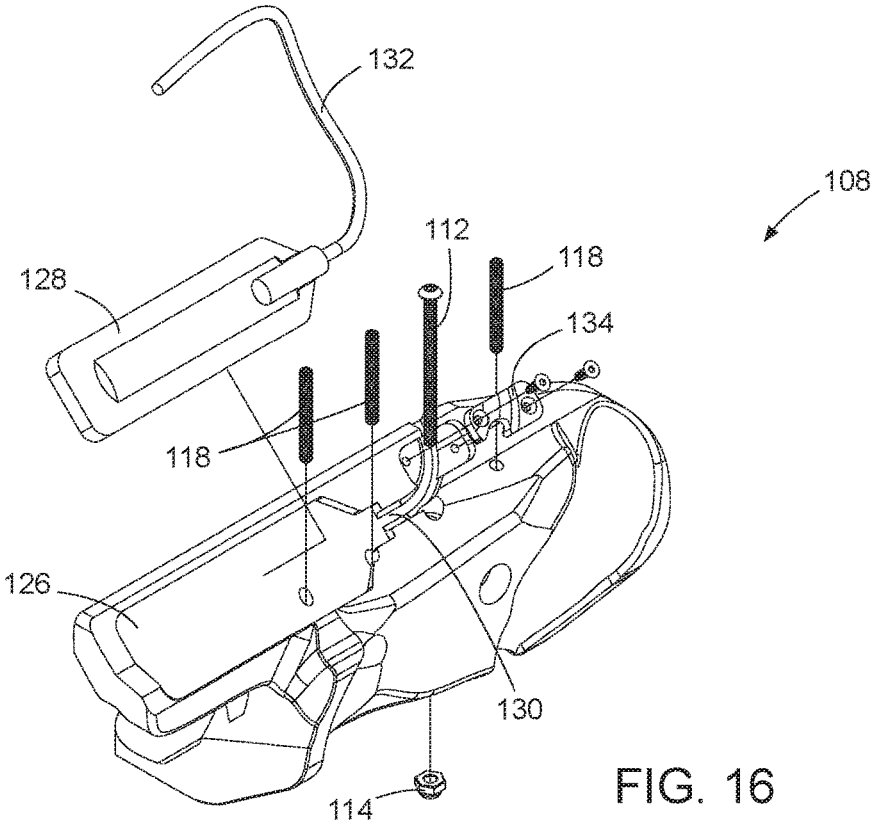
FIG. 16 is yet another exploded perspective view of the grip of the rifle shown in FIG. 1.
Figure 17:
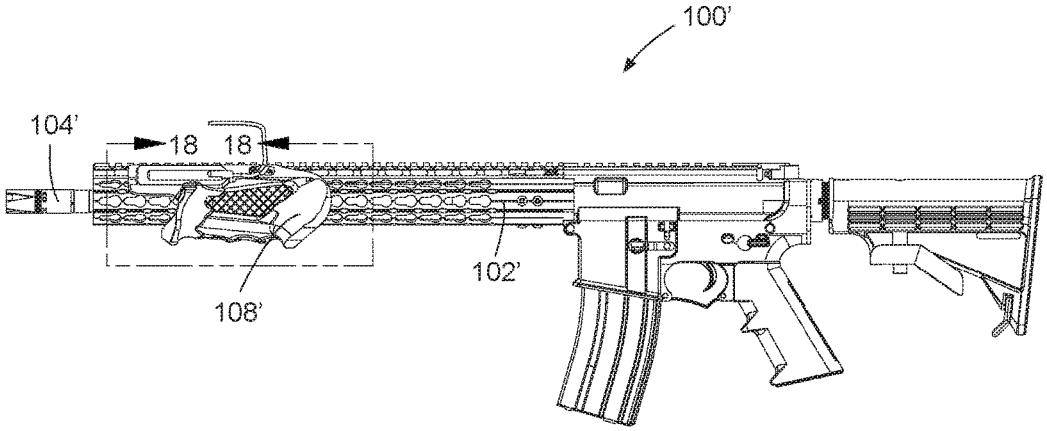
FIG. 17 is a side view of another rifle having a grip in accordance with the invention.
Figure 18:
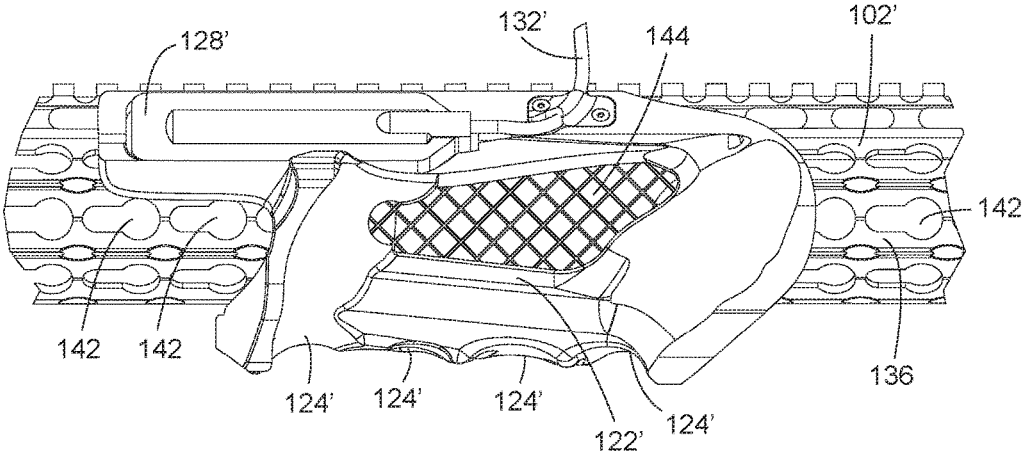
FIG. 18 is a detail view of FIG. 17 within the region bound by the line 18-18 and focuses on the grip.
Figure 19:
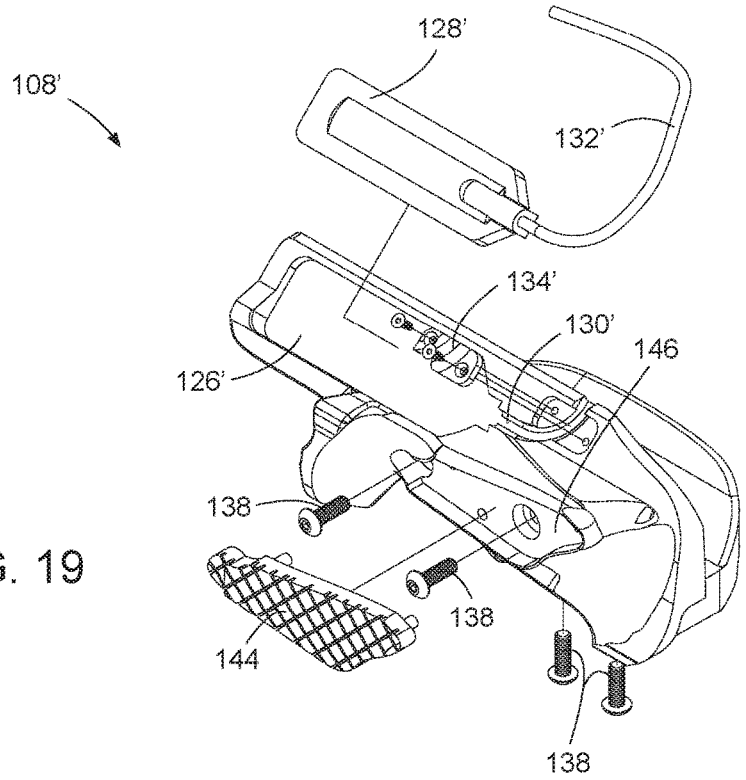
FIGS. 19-21 are exploded perspective views of the grip of the rifle shown in FIG. 17.
Figure 20:
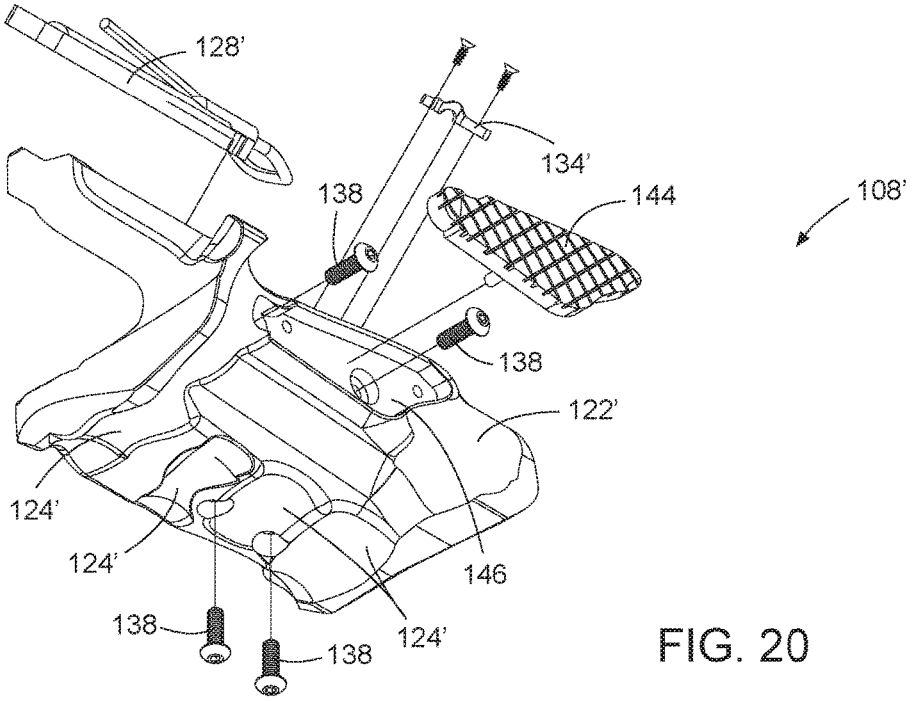

A first embodiment of a rifle comprising a grip in accordance with the invention is shown in FIGS. 1-10. The rifle (100) is a semi or fully automatic rifle and comprises a handguard (102) that encircles the barrel (104) of the rifle in a radially spaced manner. The radial space between the barrel (104) and the handguard (102) is most evident in FIG. 10. The handguard (102) shown on the rifle (100) is a common style of handguard that comprises four individual Picatinny rails (106), one on top of the handguard, one on the bottom of the handguard, and one on each side of the handguard. The grip (108) is shown by itself in FIGS. 11-16 and is adapted to be secured to one of the side Picatinny rails (106). As can be seen most clearly in FIGS. 10 and 13, the grip (108) comprises a channel (110) that is complementary to a Picatinny rail (106). The grip (108) also comprises a locking screw (112) that cooperates with a nut (114) to squeeze the opposite sides (116) of the channel (110) toward each other to thereby firmly secure the grip axially along the Picatinny rail (106). To distribute longitudinal loads between the grip (108) and the Picatinny rail (106), the grip may also comprise additional screws (118), each of which merely extends through one of the transverse grooves (120) of the Picatinny rail (106) to prevent longitudinal slippage between the grip and rail (see FIG. 7 in particular).

The exterior of the grip (108) is contoured in a manner such that the grip is one of either left handed or right handed. The grip (108) shown in the FIGS. 1-16 is configured to be gripped by one's left hand. More specifically, a palm indentation (122) is provided in the side of the grip (108) and four finger channels (124) are provided on the bottom of the grip that extend transversely across the bottom of the rifle (100). The finger channels (124) also preferably turn upwards slightly after extending across the bottom of the rifle (100) from the palm side of the grip. Thus, the grip (108) is configured such that a shooter places his or her palm in the palm indentation (122) of grip and wraps his or her fingers transversely across the bottom of the grip and rifle (100) in the finger channels (124). This leaves the shooter's thumb along the side of the grip (108) pointing generally toward the discharge end of the rifle (100). That being said, the grip is also provided with a pressure switch recess (126) into which a pressure switch (128) can be placed and easily activated by a shooter's thumb. A channel (130) for the wire lead (132) of the pressure switch (128) may also be provided, as may a retaining clip (134) for holding the wire lead in the channel. The wire lead (132) can be attached to one or more rifle accessories (not shown), such as a laser, a flashlight, night vision, a video recorder, etc. Such accessories may be attached to the handguard (102) of the rifle (100) or may be worn by the shooter. Regardless, the position of the pressure switch (128) on the grip (108) allows a shooter to activate and deactivate the accessory via his or her thumb without disengaging his or her grasp of the grip and without taking his or her eyes off of a target. Thus, the shooter can remain ready to fire while he or she actuates the pressure switch (128).

Figure 21:
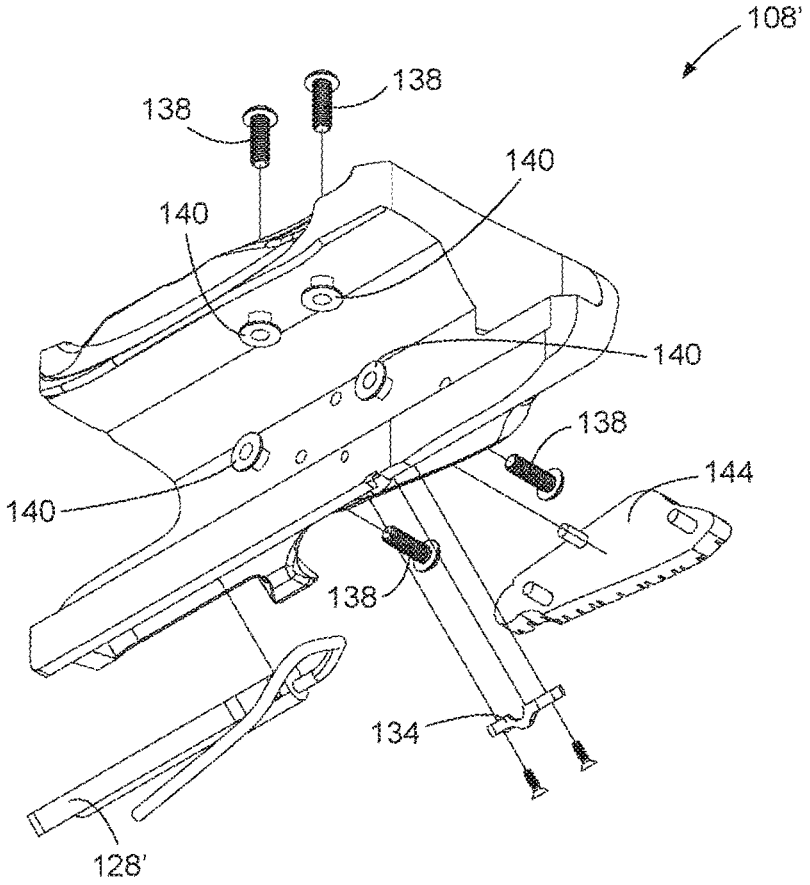

Another embodiment of the rifle comprising a grip in accordance with the invention is shown in FIGS. 17-21. In this other embodiment, rifle (100') comprises a handguard (102') that has four KeyMod rails (136) rather than Picatinny rails. As such, rather than having a channel that is complementary to a Picatinny rail, the grip (108') of this embodiment is configured to interface with at least a side KeyMod rail (136) of the handguard (102'). As shown in FIG. 21, the grip (108') may be configured to interface with both a side KeyMod rail (136) and a bottom KeyMod rail of the handguard (102'). The grip (108') is locked onto the handguard (102') via screws (138) and nuts (140) that resemble weld nuts. The large portions of the nuts (140) are inserted through the large portions of the respective key-slots (142) of the KeyMod rail (136) and then the grip is forced forward relative to the handguard (102') such that the screws (138) move into the narrow portions of the respective key-slots (142), where they are then tightened. This version of the grip (108') is shown with an optional screw cover plate (144) that could also be provided on Picatinny rail style grip (108). The screw cover plate (144) is press fit into a cover plate recess (146), where it then conceals the heads of two of the mounting screws (138). As shown, the exterior surface of the screw cover plate (144) could be textured, for example, with grip pattern. Thus, aside from the handguard interface, the KeyMod style grip (108') and the Picatinny style grip (108) may share the features. Moreover, it should be appreciated that other grips in accordance with the present invention could be configured for interfacing with other style rails or handguards.

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed, unless such an order is inherent.

What is claimed is:

1. In a rifle including a gun barrel, a handguard adapted to mount to the rifle encircling and radially spaced from the barrel, the handguard comprising:

a handguard body having opposite sides, a top and a bottom thereof;

and a grip part affixed to the handguard;

and an electronic pressure switch mounted to the grip part and configured and adapted to actuate an electrical rifle accessory, the grip part being exteriorly fixed to the handguard body, the grip being configured and adapted to be only one of left or right handed, the grip part includes an integral first body part and an integral second body part, the first body part being further adapted and configured such that, when operating the rifle, a person's palm can extend adjacent one of the opposite sides of the handguard with the grip part therebetween and the person's fingers can extend across and below the bottom of the handguard with the first body part therebetween, the first body part extending partially around the handguard and over one of the opposite sides and the bottom of the handguard body when mounted to the handguard and the first body part having a muzzle end and a receiver end thereof, the second body part extending longitudinally forward beyond the muzzle end of the first body part along the one of the opposite sides of the handguard body, the pressure switch is located on the second body part in a position where, when operating the rifle and holding the handguard, the pressure switch can be actuated via a person's thumb while the person's palm remains extended adjacent the one of the opposite sides of the handguard body and the person's fingers remain extended across and below the bottom of the handguard body.

2. A handguard in accordance with claim 1 wherein the first body part has four exterior finger channels defined therein.

3. A handguard in accordance with claim 2 wherein the finger channels overlie and extend transversely across the bottom of the handguard.

4. A handguard in accordance with claim 1 wherein the grip part is mounted to the handguard via at least one screw and the grip part includes at least one screw cover plate that conceals the at least one screw.

5. A handguard in accordance with claim 1 wherein the handguard body includes at least one Picatinny rail and the grip part is configured and adapted to be fixed to the handguard via the Picatinny rail.

6. A handguard in accordance with claim 1 wherein the handguard body includes a KeyMod interface and the grip part is configured and adapted to be fixed to the handguard directly via the KeyMod interface.

7. A handguard in accordance with claim 1 wherein the first body part has a palm indentation defined therein for receiving the person's palm when operating the rifle and holding the grip, and the palm indentation is spaced from the second body part.

8. A grip for a rifle where the rifle includes a gun barrel, and a handguard encircling and radially spaced from the barrel and having a top, bottom and opposite sides thereof, the grip comprising, a grip body and an electronic pressure switch mounted to the grip body and configured and adapted to actuate an electrical rifle accessory, the grip body being configured and adapted to be mounted to the handguard of the rifle and being only one of left or right handed, the grip body includes an integral first body part and an integral second body part, the first body part extending partially around the handguard and over one of the opposites sides and the bottom of the handguard body when mounted to the handguard, the first body part having a muzzle end and a receiver end thereof, the first body part being further adapted and configured such that, when operating the rifle and holding the grip, a person's palm will extend adjacent one of the opposite sides of the handguard with the grip therebetween and the person's fingers will extend across and below the bottom of the handguard with the grip therebetween, the second body part extending longitudinally forward beyond the muzzle end of the first body part along the one of the opposite sides of the handguard body, the pressure switch is located on the second body part in a position where, when operating the rifle and holding the grip, the pressure switch can be actuated via a person's thumb while the person's palm remains extended adjacent the one of the opposite sides of the handguard and the person's fingers remain extended across and below the bottom of the handguard.

9. A grip in accordance with claim 8 wherein the first body part having four exterior finger channels defined therein.

10. A grip in accordance with claim 8 wherein the grip is configured and adapted to be mounted to the handguard via at least one screw and the grip comprises at least one screw cover plate that conceals the at least one screw.

11. A grip in accordance with claim 9 wherein the finger channels overlie and extend transversely across the bottom of the handguard.

12. A grip in accordance with claim 8 wherein the first body part has a palm indentation defined therein for receiving the person's palm when operating the rifle and holding the grip, and the palm indentation is spaced from the second body part.

* * * * *